United States Patent [19]

Hollowell

[11] Patent Number: 4,911,673

[45] Date of Patent: Mar. 27, 1990

[54] TOY VIEWING APPARATUS ASSEMBLY KIT

[76] Inventor: John R. Hollowell, P.O. Box 2217, Dearborn, Mich. 48123

[21] Appl. No.: 227,726

[22] Filed: Aug. 3, 1988

[51] Int. Cl.[4] ..... A63H 33/22

[52] U.S. Cl. ..... 446/219; 350/557; 350/569

[58] Field of Search ..... 446/219, 85, 89; 434/303; 350/539–544, 537, 557, 569

[56] References Cited

U.S. PATENT DOCUMENTS

| | | | |
|---|---|---|---|
| D. 160,304 | 10/1950 | Crichton . | |
| 737,844 | 9/1903 | Hubbard . | |
| 1,145,022 | 7/1915 | Keuffel . | |
| 1,635,011 | 7/1927 | Sadler . | |
| 2,551,243 | 5/1951 | Campbell . | |
| 2,738,753 | 3/1956 | Eubank . | |
| 3,122,859 | 3/1964 | La Reaux, Jr. . | |
| 3,507,075 | 4/1970 | Schmidt . | |
| 3,533,625 | 10/1970 | Kossor et al. | 446/219 X |
| 4,132,028 | 1/1979 | Ogawa | 446/219 X |
| 4,134,637 | 1/1979 | Leisegang . | |

FOREIGN PATENT DOCUMENTS

| | | | |
|---|---|---|---|
| 742173 | 11/1943 | Fed. Rep. of Germany . | |
| 586414 | 1/1978 | U.S.S.R. . | |
| 20870 | of 1896 | United Kingdom | 446/219 |
| 954629 | 4/1964 | United Kingdom . | |

*Primary Examiner*—Mickey Yu

*Attorney, Agent, or Firm*—Harness, Dickey & Pierce

[57] ABSTRACT

A toy viewing assembly kit for producing multi-directional image reflecting configurations. The kit is comprised of a plurality of angular reflecting sections having reflecting elements disposed therein and hollow extension sections. The individual sections having coupling portions for permitting removable interconnection thereof. The coupling portions allowing unrestricted axial rotations of adjacently connected sections thereby creating multi-directional assembly configurations. The assembly configurations provide multi-axis image reflections viewable by the child user.

12 Claims, 2 Drawing Sheets

FIG. 1
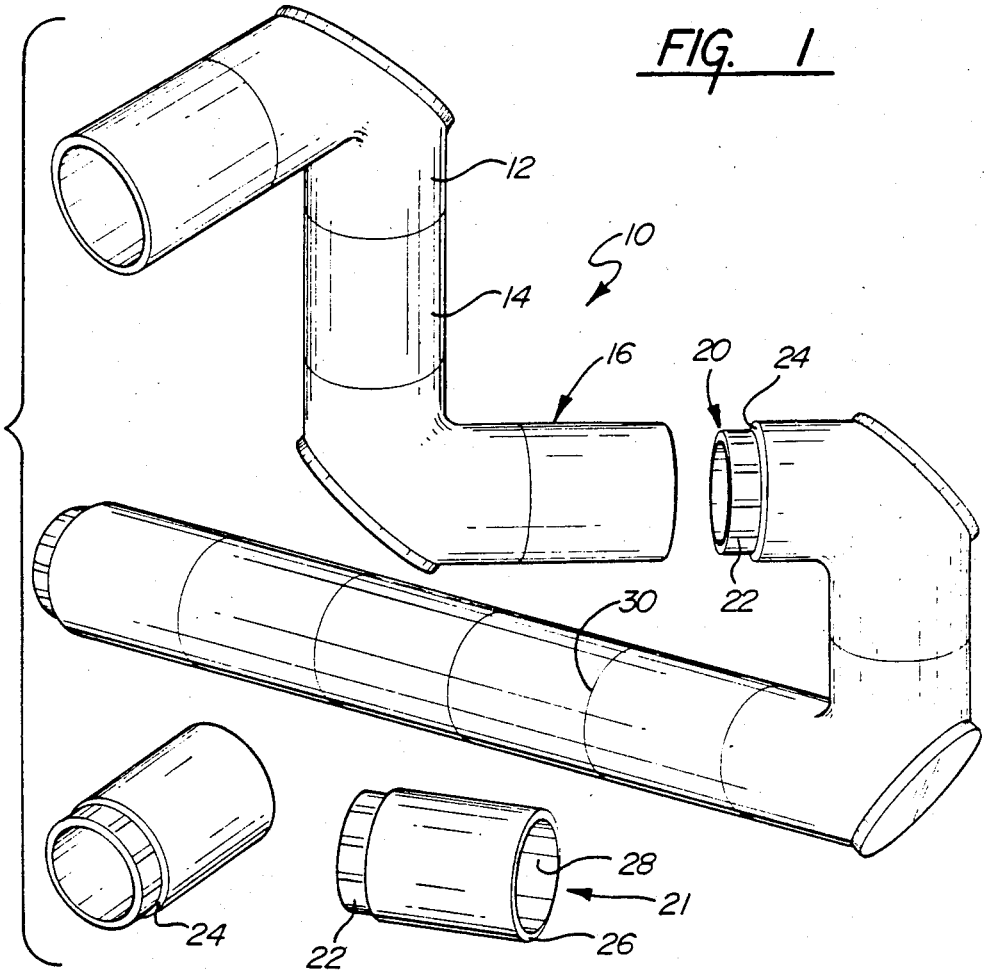
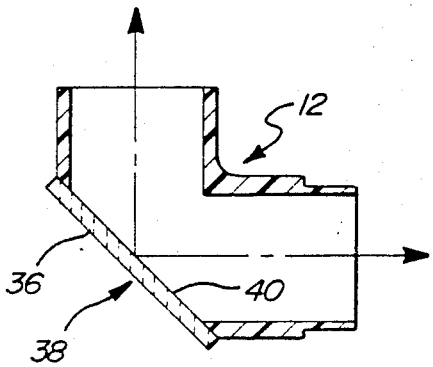
FIG. 4
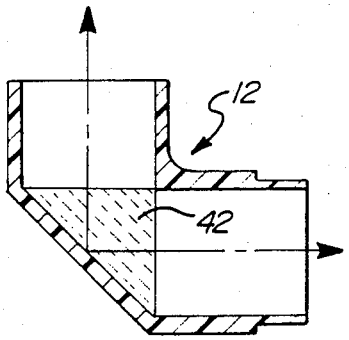
FIG. 5

TOY VIEWING APPARATUS ASSEMBLY KIT

BACKGROUND OF THE INVENTION

1. Field of the Invention

The present invention relates generally to a child's toy, and more particularly to a multi-piece toy viewing kit for assembling multi-directional image reflecting configurations.

2. Description of the Related Art

Numerous devices are known in the art for reflecting an image of a viewed object. Typically, such devices are commonly referred to as periscopes. However, periscope-type devices are generally rigidly constructed so as to restrict their directional image reflecting characteristics. Further, such devices typically utilize optical lens for producing the desired optical reflection of a viewed object.

The novelty of the present invention lies in its functional utility as a child's toy which is capable of random assembly configurations limited only by the imagination of the child user. The viewing assembly kit provides sectional components that can be randomly interconnected and rotated relative to each other so as to create multi-directional image reflecting configurations.

Accordingly, it is a primary object of this invention to provide a toy viewing kit having a plurality of individual sectional components capable of random interconnected assembly so as to produce multi-directional image reflecting configurations.

Additionally, it is an object of this invention to provide a toy which is easy to operate, so as to maintain and challenge the interest and imagination of the child user.

Also, it is an object of this invention to provide a toy which is fabricated from durable and sturdy materials, which can be manufactured economically.

Specifically, the toy viewing kit according to the present invention provides a simple image reflecting viewing toy which permits random assembly configurations. The kit includes sectional components which can be removably interconnected by the child user. Multiple pairs of angular reflecting sections are supplied within the kit. The angular reflecting sections are substantially 90° tubular members having a reflecting means disposed therein so as to generate approximately 90° of relative image reflection. Hollow tubular extension sections, which can be removably interconnected with each other and the angular reflecting sections, are also included within the toy viewing kit. Each of the interconnected sections is freely rotatable along their common interconnected axis. Therefore, it is possible for the child user to assemble the angular and extension sections into random configurations with section freely rotatable, such that the assembled configuration produces a reflected image of the object viewed. The child user can create image reflecting assemblies for, i.e., looking around doorways, looking over furniture, or even viewing a reflection of his own eyes or an ear. The aforementioned toy configurations exemplify, without limiting, this novel invention's ability to entertain the child user.

BRIEF DESCRIPTION OF THE DRAWINGS

Various advantages of the present apparatus will become apparent to one skilled in the art upon reading the following detailed description and by reference to the following drawings in which:

FIG. 1 is a perspective view of a random configuration of the angular and extension sectional components included in the toy viewing assembly kit and of the coupling means provide for removably interconnecting the components which permit free axial rotation thereof;

FIG. 4 is a sectional view of an angular reflecting sectional component showing the substantially 90° image reflection generated by a reflective mirror surface according to a preferred embodiment of the present invention; and FIG. 5 is a sectional view of an angular reflecting sectional component according to a second embodiment of the present invention, which produces substantially 90° image reflection utilizing a prism-type device.

DESCRIPTION OF THE PREFERRED EMBODIMENTS

Figure 2:
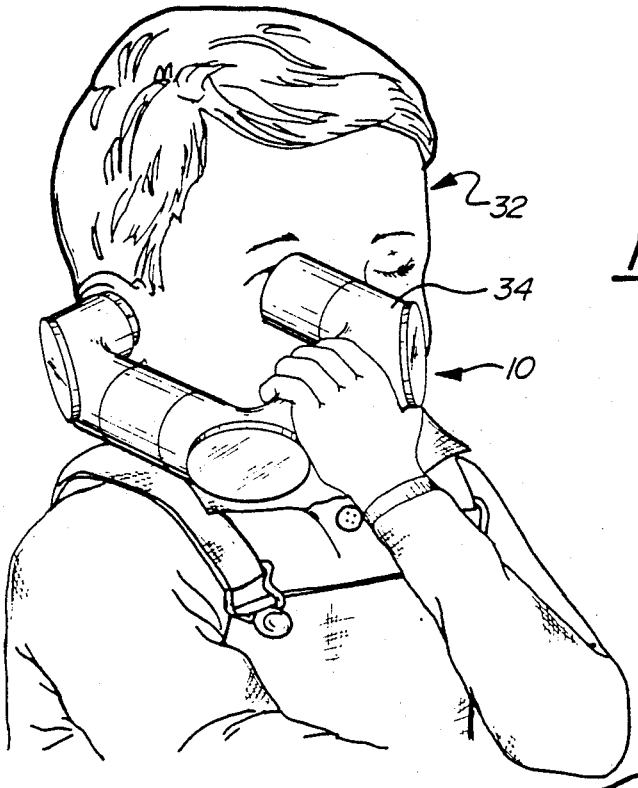
FIG. 2 is a pictorial view illustrating a child user viewing his own ear using a viewing toy assembly configuration randomly assembled from the assembly kit according to the present invention.

Referring to FIG. 1, a toy viewing assembly kit 10 according to the preferred embodiment of the present invention is shown. The toy viewing assembly kit 10 comprises a plurality of individual angular reflecting sections 12 and individual extension sections 14. A combination of angular reflecting sections 12 and extension sections 14 are shown in FIG. 1 creating an interconnected assembly configuration 16. Assembly configuration 16 exemplifies the multi-directional image reflecting characteristics embodied in the present invention. The angular reflecting sections 12 and extension sections 14 are generally tubular with the angular reflecting sections 12 of a right circular tubular construction designed to provide substantially 90° of optical axis deflection. The angular axis deflection of a viewed object produces a reflected image of that object will be defined in greater detail hereinafter. Angular reflecting sections 12 and extension sections 14 are provided with individual coupling means so as to be removably interconnectable. The coupling means provided on sections 12 and 14 comprise socket means 20 on one end and socket receiving means 21 on their opposite end. The socket means 20 define an area at one end of sectional components 12 and 14 having a reduced outer surface diameter. The reduced outer surface diameter 22 abuts a radially outward extending shoulder 24. Shoulder 24 will matingly contact flush end surface 26 associated with the socket receiving means 21 of an adjacently interconnected sectional component. Upon assembled interconnection, the reduced outer surface diameter 22 of socket means 20 will matingly engage the inner peripheral surface 28 of the adjacent sectional component assembled thereto. Inner peripheral surface 28 defines the socket receiving means 21 associated with sectional components 12 and 14. Therefore, the outer surface diameter 22 of the socket means 20 matingly engage the inner peripheral surface 28 of socket receiving means 21 so as to allow flush end surface 26 and shoulder 24 to radially contact. The removably coupled connection 30 of the adjacently located sectional components creates an assembly of uniform outer diameter. Further, the randomly assembled sections 12 and 14 can freely rotate axially relative to each other along their coupled connection 30. The peripheral engagement of outer surface diameter 22 with inner peripheral surface 28 of an adjacently connected sectional component permits 360° of axial rotation.

Figure 3:
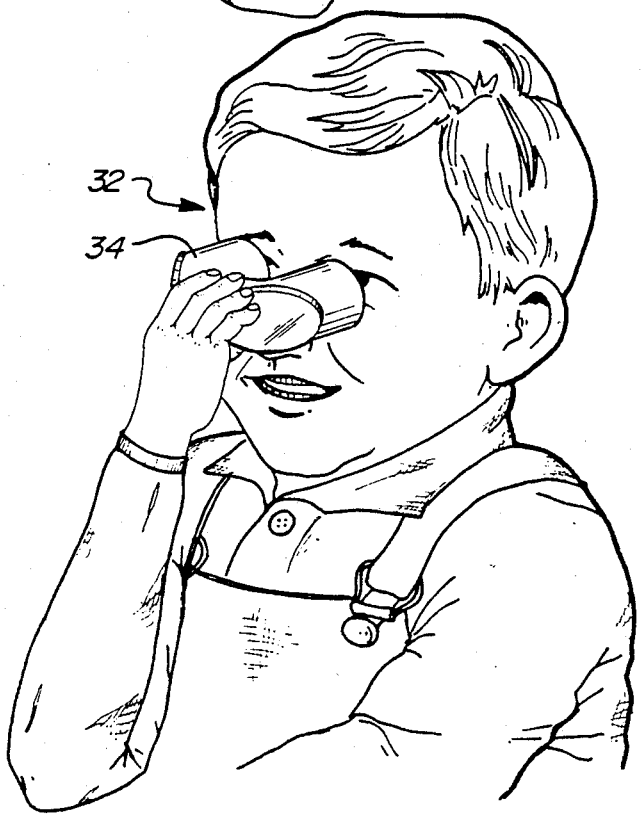
FIG. 3 is a pictorial view showing a child user viewing a reflection of his own eyes utilizing a different toy assembly configuration than that shown in FIGS. 1 and 2.

With reference now to FIG. 2 a child user 32 is shown viewing a reflection of his own ear using a toy viewing configuration 34 assembled from the toy viewing kit 10. FIG. 3 illustrates a child user 32 viewing a image reflection of his own eyes via an assembled toy configuration 34. FIGS. 2 and 3 illustrate nonlimiting examples of the imaginative view reflecting assembly configurations which can be assembled utilizing toy viewing assembly kit 10.

FIG. 4 shows a cross-sectional view of angular reflecting section 12 according to a preferred embodiment of the present invention. Angular reflecting section 12 is shown having a mirror member 36 angularly secured at its outermost cornered surface 38. Mirror member 36 has a reflective surface 40. Mirror reflecting surface 40 acts to direct a reflected image of the viewed object through substantially 90° of angular deflection.

FIG. 5 details a second embodiment of the present invention in which the reflecting means dispose within angular reflecting section 12 comprises a prism 42. Prism 42 also acts to direct a reflected image of the viewed object through substantially 90° of angular deflection.

The top viewing assembly kit 10 embodied in this invention consists of a plurality of generally tubular angular reflecting sections 12 and hollow extension sections 14 each having an inner diameter sized to provide comfortable and unobstructed image viewing. According to the preferred embodiment, the outside diameter of the tubular sections is defined as approximately $1\frac{7}{8}$" having a wall thickness designed to provide durable and rigid assembly configurations. It is contemplated that the sectional components 12 and 14 of viewing assembly kit 10 could be fabricated from any material providing the requisite rigidity and durability, with the components preferably fabricated from a plastic material.

While the above description constitutes the preferred embodiments of the present invention, it will be appreciated that the invention is acceptable to modification, variation and change without departing from the proper scope and fair meaning of the accompanying claims.

What is claimed is:

1. A toy viewing assembly kit for producing a reflected image of a viewed object, comprising:

at least one pair of reflecting means for angularly deflecting a viewable image of said object;

at least one extension means for optically extending the distance between said viewed object and said reflected image;

socket means provided on one end of said reflecting means and said extension means and socket receiving means provided on an opposite end thereof for removably interconnecting said reflecting means and said extension means in random assembly configurations, said socket means and said socket receiving means permitting rotational movement of each of said reflecting means and said extension means relative to the other along their common axis; and whereby random interconnected association of said reflecting means and said extension means permits multi-directional image deflection, thereby producing multi-axis image reflecting assembly configurations.

2. The toy viewing assembly kit according to claim 1, wherein said extension means comprises a hollow circular tubular section.

3. The toy viewing assembly kit according to claim 1, wherein said reflecting means comprises a substantially 90° right circular tubular section having a reflective member disposed therein so as to deflect said optical image accordingly.

4. The toy viewing assembly kit according to claim 3, wherein said reflective member disposed within said right circular tubular section acts to direct said reflected image of said viewed object through substantially 90° of angular deflection.

5. The toy viewing assembly kit according to claim 4, wherein said reflective member comprises a mirror surface.

6. The toy viewing assembly kit according to claim 4, wherein said reflective surface comprises a prism.

7. A toy viewing assembly kit for producing a deflected optical image of a viewed object, comprising:

at least three substantially right-angled tubular reflecting sections having an internally disposed reflecting means for producing and angularly deflecting an image of said object;

at least one tubular extension section for optically communicating with said object or a reflected image thereof;

socket means on one end of said tubular reflecting sections and said extension section and socket receiving means on an opposite end thereof, said socket means for directly removably interconnecting said tubular reflecting sections and extension section in random assembly configurations so as to permit multi-axis rotation of said interconnected sections; and whereby random interconnected assembly of said tubular sections create optically reflected images of said viewed object.

8. A toy viewing assembly kit according to claim 7, wherein said reflecting means comprises a prism.

9. A toy viewing assembly kit according to claim 7, wherein said reflecting means comprises a mirror-type reflecting surface.

10. A toy viewing assembly kit according to claim 7, wherein said socket means at an end of said angular reflecting and extension sections comprises an axially extending circumferential surface having a reduced outer diameter, said socket receiving means comprises an inner diameter surface on said end opposite said socket means.

11. A toy viewing assembly kit according to claim 10, wherein said reduced outer surface diameter of said socket means is dimensioned so as to radially matingly engage said inner diameter surface of said socket receiving means associated with an adjacent tubular section removably interconnected thereto, said mating engagement provided upon axial insertion of said reduced outer diameter surface into said inner diameter surface thereby producing a rotatable, removably interconnected assembly configuration.

12. A toy viewing assembly kit according to claim 11, wherein said mating radial engagement of said inner diameter surface provided on an end of said tubular reflecting section or said tubular extension section with said reduced outer diameter of an adjacent tubular reflecting section or extension section produces a removably interconnected assembly configuration with said interconnected sections capable of 360° of axial rotation relative to their common axis.

* * * * *

UNITED STATES PATENT AND TRADEMARK OFFICE

CERTIFICATE OF CORRECTION

PATENT NO. : 4,911,673

DATED : March 27, 1990

INVENTOR(S) : John R. Hollowell

It is certified that error appears in the above-identified patent and that said Letters Patent is hereby corrected as shown below:

On the title page:
Item [56] under "Foreign Patent Documents," after "20870" delete "of" and insert therefore -- 10/ --.

Column 1, line 54, after "with" insert -- each --.

Column 3, line 9, After "viewing" delete "a" and insert therefore -- an --.

Column 3, line 28, delete "top" and insert therefore -- toy --.

Signed and Sealed this

Twelfth Day of November, 1991

*Attest:*

HARRY F. MANBECK, JR.

*Attesting Officer*

*Commissioner of Patents and Trademarks*